US005365226A

United States Patent [19]

Morishima

[11] Patent Number: 5,365,226

[45] Date of Patent: Nov. 15, 1994

[54] RADIO COMMUNICATION APPARATUS CAPABLE OF PREVENTING UNINTENTIONAL DISPLAY OPERATION

[75] Inventor: Masaaki Morishima, Tokyo, Japan

[73] Assignee: NEC Corporation, Japan

[21] Appl. No.: 137,688

[22] Filed: Oct. 15, 1993

Related U.S. Application Data

[63] Continuation of Ser. No. 797,309, Nov. 25, 1991, abandoned.

[30] Foreign Application Priority Data

Nov. 26, 1990 [JP] Japan ..... 2-318002

[51] Int. Cl.[5] ..... G08B 5/22

[52] U.S. Cl. ..... 340/825.44; 455/38.3; 455/38.4

[58] Field of Search ..... 340/825.44, 825.45, 340/825.46, 825.47, 825.48, 825.65, 311.1; 455/38.2, 38.3, 38.4; 200/43.01

[56] References Cited

U.S. PATENT DOCUMENTS

| | | | |
|---|---|---|---|
| 4,087,793 | 5/1978 | Lucas | 340/825.65 |
| 4,786,902 | 11/1988 | Davis et al. | 340/825.44 |
| 4,959,644 | 9/1990 | Sato | 340/825.44 |
| 5,105,189 | 4/1992 | Murai et al. | 340/825.44 |

FOREIGN PATENT DOCUMENTS

| | | | |
|---|---|---|---|
| 0275165 | 7/1988 | WIPO . | |
| 8906477 | 7/1989 | WIPO . | |
| WO9104640 | 4/1991 | WIPO | 340/825.44 |

*Primary Examiner*—John K. Peng
*Assistant Examiner*—Andrew Hill
*Attorney, Agent, or Firm*—Ostrolenk, Faber, Gerb & Soffen

[57] ABSTRACT

In a radio communication apparatus having an individual call number for use in receiving a call signal and a message signal representing a message and following the call signal, the apparatus being capable of operating in one of a standby mode wherein the apparatus is waiting to receive a call signal that is coincident with the individual call number and a message received mode wherein the apparatus has received a call signal that is coincident with the individual call number, a push button switch (11 or 12) is provided for setting an operation mode of a display unit (24), and a control unit (32) is provided to control the display unit to make the display unit carry out a display operation of the received message. A slide switch (31) is provided to set an inhibition mode of operation, in which the slide switch is positioned at a predetermined position (P3), whereby operation of the push button switch is inhibited from controlling the display unit to carry out a display operation when the apparatus is in the standby mode of operation, and therefore prevent unintentional operation of the display unit caused by undesired activation of the push button switch and consequently conserve battery power. Further, the control unit cancels the inhibition operation mode in response to receiving a call signal having said individual call number, whereby standby operation mode is necessarily changed to the message received.

2 Claims, 5 Drawing Sheets

RADIO COMMUNICATION APPARATUS CAPABLE OF PREVENTING UNINTENTIONAL DISPLAY OPERATION

This is a continuation of application Ser. No. 07/797,309 filed on Nov. 25, 1991, abandoned.

BACKGROUND OF THE INVENTION

This invention relates to a radio communication apparatus for selectively receiving a plurality of call signals indicative of a plurality of call numbers, respectively. The radio communication apparatus may be a radio paging receiver, a transceiver, or the like although description will be mainly made about the radio paging receiver.

A radio paging receiver of the type described deals with a plurality of call signals and a plurality of message signals following the call signals, respectively. The radio paging receiver has an individual call number and comprises a receiving circuit for receiving each of the call signals as a received call signal.

In a conventional radio paging receiver, a control unit is connected to the receiving circuit. The control unit has a judging function for judging whether or not the received call signal is coincident with the individual call number. When the received call signal is coincident with the individual call number, the control unit controls an annunciator, such as a tone generator or a vibrator, to make the annunciator carry out an announcing operation. For example, if the annunciator the tone generator, the annunciator generates a particular audible tone to announce reception of the received call signal which is coincident with the individual call number.

When the received call signal is coincident with the individual call number, the control unit receives the message signal following the received call signal as a received message signal representative of a message. The control unit comprises a memory and stores the message in the memory as a stored message. Simultaneously, the control unit supplies the message signal to a display unit, such as a liquid crystal display provided with a back light. The display unit puts the back light on and displays the message. In the manner which is presently being described, the stored message is arbitrarily read out of the memory and can be displayed by the display unit.

The radio paging receiver further comprises a push button switch which is manually operable to set an operation mode of the annunciator, the display unit., or the like. Briefly, if the push switch is pushed by the possessor on generation of the particular audible tone, the control unit controls the annunciator to make the annunciator stop the announcing operation. After stopping of the announcing operation, if the push button switch is pushed again, the control unit controls the display unit to make the display unit put the back light off and stop display of the message. After this the radio paging receiver is put into a standby mode. In the standby mode, if the push button switch is pushed, the control unit reads the stored message out of the memory and supplies the stored message to the display unit. In this state, the display unit puts the back light on again and displays the stored message. Thus, the stored message can arbitrarily be displayed by the display unit.

A recent remarkable development of an integrated circuit technique has rendered the radio paging receiver compact or portable and multifunctional. Preferably, the radio paging receiver has a long life. Inasmuch as a battery is used as a power source in the radio paging receiver, the radio paging receiver has a life time dependent upon the life of the battery. Therefore, electric power must not be wasted in the radio paging receiver. In other words, useless and unintentional operation should be prevented.

The radio paging receiver comprises a case which contains a circuit board having circuit arrangements of the radio paging receiver. The push button switch is fixed to the circuit board so that the push button switch protrudes from a main surface of the case. This causes a disadvantage for the following reason. The radio paging receiver is often put in a pocket, such as a breast pocket of a jacket, of a possessor together with a small notebook or the like. The radio paging receiver may be put in a bag, such as an attache case, together with books or the like. In this case, the small notebook or the books may push the push button switch regardless of possessor's intention. In this time, if the radio paving receiver is put into the standby mode, the display unit puts the back light on and is put into display operation of the stored message regardless of whether the possessor wants it or not. Such a display operation is, so to speak, an unintentional display operation. This means that the electric power is wasted in the radio paging receiver, particularly by unintentionally activating the back light and stored message display operation.

SUMMARY OF THE INVENTION

It is therefore an object of this invention to provide a radio communication apparatus capable of preventing an unintentional display operation caused by an unintentionally activation of a push button switch.

Other objects of this invention will become clear as the description proceeds.

On describing the gist of this invention, it is possible to understand that a radio communication apparatus has an individual call number and comprises receiving means for receiving a call signal, as a received call signal, and a message signal following the call signal and representing a message, judging means connected to the receiving means for judging whether or not the received call signal is coincident with the individual call number, the judging means producing the message signal when the received call signal is coincident with the individual call number, display means connected to the judging means for displaying the message, mode setting means for setting operation mode of the display means, and inhibition means connected to the mode setting means for inhibiting operation of the mode setting means.

DESCRIPTION OF THE PREFERRED EMBODIMENT

Figure 2:
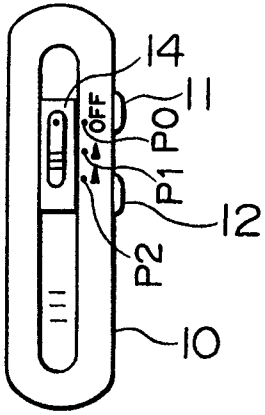
PRIOR ART FIG. 2
FIG. 2 is a side view of the radio paging receiver illustrated in FIG. 1.
Figure 1:
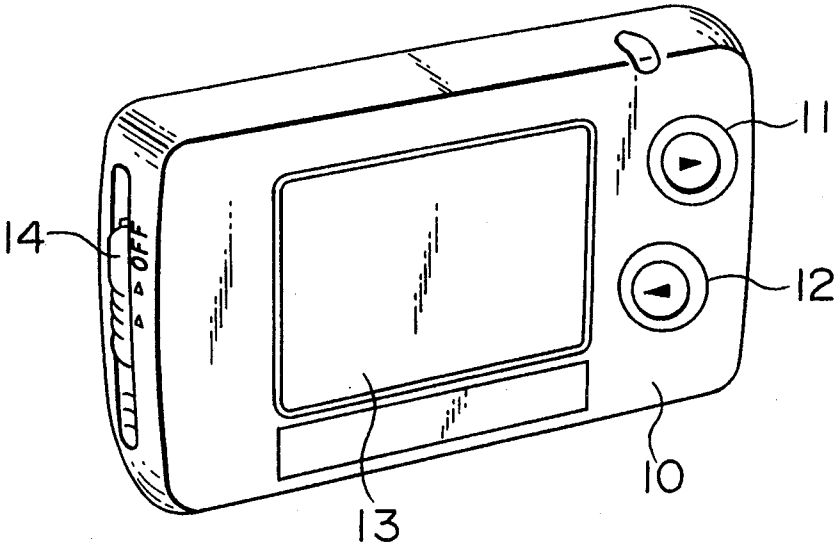
PRIOR ART FIG. 1
FIG. 1 is a perspective view of a conventional radio paging receiver.
Figure 3:
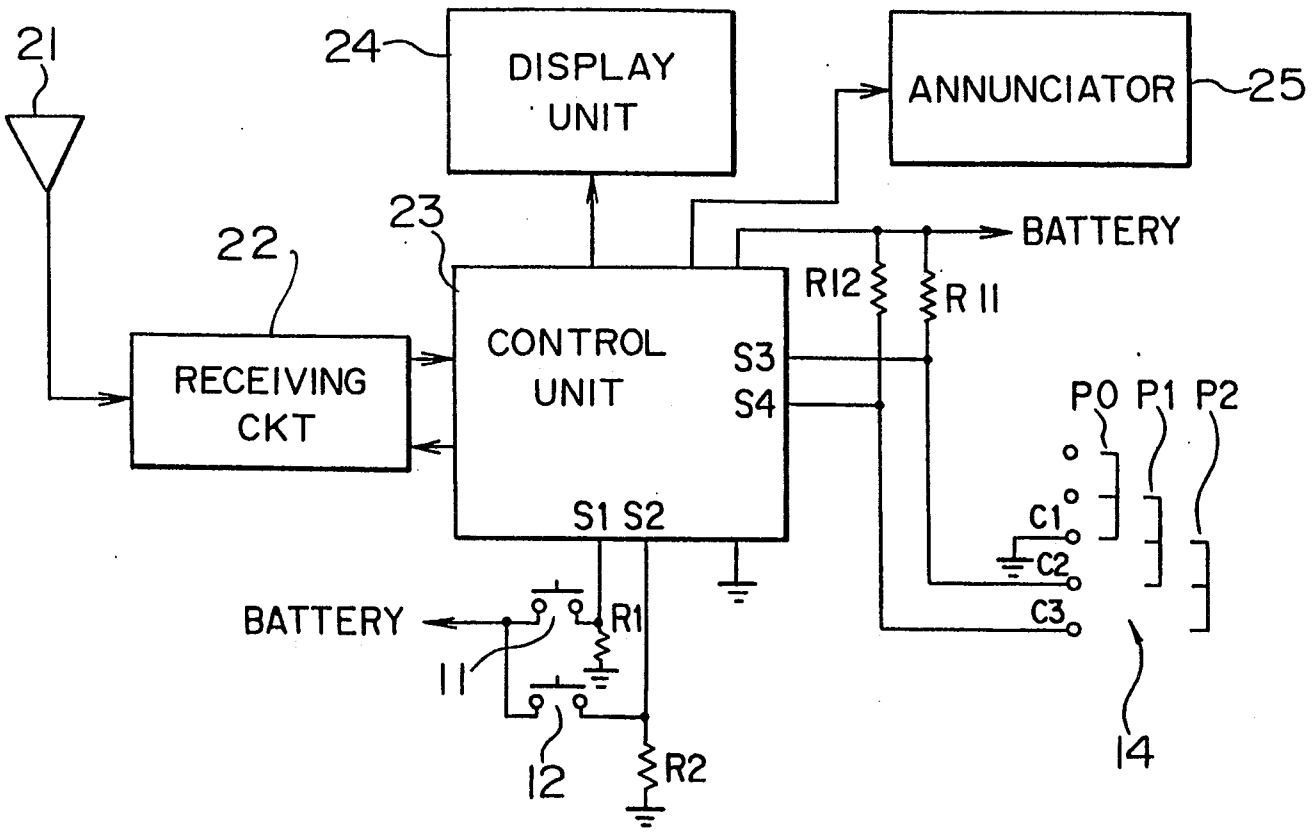
FIG. 3 PRIOR ART
FIG. 3 is a block diagram of the radio paging receiver illustrated in FIG. 1.

Referring to FIGS. 1 to 3, a conventional radio paging receiver will be described first to facilitate an understanding of the present invention. The radio paging receiver is for selectively receiving a plurality of call signals and a plurality of message signals following the plurality of call signals, respectively. Each of the plurality of call signals indicates each of a plurality of call numbers. Bach of the plurality of message signals represents each of a plurality of messages. Each of the call signals and each of the message signals are transmitted from a transmitting station (not shown). An individual call number is assigned to the radio paging receiver. The radio paging receiver is for use in combination with a battery (not shown) for generating electric power.

In FIG. 1, the radio paging receiver comprises a case 10 containing an electric circuit board (not shown) mounted with electric circuits of the radio paging receiver. The radio paging receiver is provided with first and second push button switches 11 and 12 so that the first and the second push button switches 11 and 12 protrude from a main surface of the case 10. As will later be described, the first and the second push button switches 11 and 12 are for setting an operation mode of the radio paging receiver. A display board 13, such as a liquid crystal display board provided with a back light, is attached to the main surface of the case 10. The radio paging receiver is further provided with a slide switch 14 so that the slide switch 14 protrudes from a side surface of the case 10. As shown in FIG. 2, the slide switch 14 is slidable among an of position, first and second positions depicted at P0, P1, and P2, respectively. As will later be described more in detail, the slide switch 14 defines an off state of the radio paging receiver when the slide switch 14 is positioned at the off position P0. Similarly, the slide switch 14 defines first and second on states of the radio paging receiver when the slide switch 14 is positioned at the first and the second positions P1 and P2, respectively.

In FIG. 3, the radio paging receiver comprises an antenna 21, a receiving circuit 22 for selectively receiving through the antenna 21 the call signals and the message signals following the call signals, respectively. The radio paging receiver further comprises a control unit 23, a display unit 24 comprising the display board 13, and an annunciator 25, such as a speaker. The control unit 23 comprises a memory (not shown) and has first through fourth terminals S1, S2, S3, and S4. The first terminal S1 is grounded through a first pull-down resistor R1 and is connected to the battery through the first push button switch 11. The second terminal S2 is grounded through a second pull-down resistor R2 and is connected to the battery through the second push button switch 12. The radio paging receiver is further provided with first through third contacts C1, C2, and C3 along a slide path of the slide switch 14. The first contact C1 is grounded. The second contact C2 is connected to the third terminal S3 and is connected to the battery through a first pull-up resistor R11. The third contact C3 is connected to the fourth terminal S4 and is connected to the battery through a second pull-up resistor R12.

When the slide switch 14 is positioned at the off position P0, the radio paging receiver is put into the off state, namely, an inactive state. In this state, each of the first and the second terminals S1 and S2 has a low voltage level or a logic zero level while each of the third and the fourth terminals S3 and S4 has a high voltage level or a logic one level. When the slide switch 14 is positioned at the first position P1, the radio paging receiver is put into the first on state, namely, an active state by the electric power. In this state, a voltage level of the third terminal S3 changes from a logic one level to a logic zero level. This is because the slide switch 14 connects between the first and the second contacts C1 and C2. Similarly, when the slide switch 14 is positioned at the second position P2, the radio paging receiver is put into the second on state, namely, the active state. In this state, a voltage level of the fourth terminal S4 changes from a logic one level to a logic zero level in addition to the third terminal S3. This is because the first contact C1 is connected to the second and the third contacts C2 and C3 through the slide switch 14.

Let the slide switch 14 be positioned at the first position P1 by the possessor. In this event, the receiving circuit 22 receives the call signal and the message signal representing a message and following the call signal as a received call signal and a received message signal, respectively, through the antenna 21. The receiving circuit 22 supplies the received call and the received message signal to the control unit 23. Supplied with the received call and the received message signals, the control unit 23 carries out at first a judging operation for judging whether or not the received call signal is coincident with the individual call number in the manner well known in the art. When the received call signal is coincident with the individual call number, the control unit 23 stores the received message signal into the memory and supplies the received message signal to the display unit 24. The control unit 23 further supplies a first audible tone signal to the annunciator 25 when the third terminal S3 has the logic zero level. The memory memorizes the received message signal as a memorized message signal. Simultaneously, the display unit 24 puts the back light on and displays the message. Supplied with the first audible tone Signal, the annunciator 25 generates an audible tone at a first predetermined volume.

If the slide switch 14 is positioned at the second position P2, the control unit 23 stores the received message signal into the memory and supplies the received message signal to the display unit 24 as mentioned before when the received call signal is coincident with the individual call number. The control unit 23 further supplies a second audible tone signal to the annunciator 25 when each of the third and the fourth terminals S3 and S4 has the logic zero level. In this case, the annunciator 25 generates the audible tone at a second predetermined volume.

The annunciator 25 may comprise the speaker and a vibrator. In this event, the control unit 23 may supply an audible tone signal to the speaker to make the speaker generate the audible tone when the slide switch 14 is positioned at the first position P1. If the slide switch 14 is positioned at the second position P2, the control unit 23 may supply a drive signal to the vibrator to vibrate the vibrator.

In addition, the memory is implemented by FIFO (first-in first-out) memory known in the art. Therefore, the memory can memorize first through n-th message signals which represent first through n-th messages where n represents a natural number. The first through the n-th message signals are received by the radio paging receiver at different times and therefore are different from one another.

Description will be made as regards mode setting by the first and the second push button switches 11 and 12.

Let the memory memorize the first through the n-th message signals as first through n-th memorized message signals. If one of the first and the second push button switches 11 and 12 is pushed by the possessor generation of the audible tone, the level of one of the first and the second terminals S1 and S2 changes from the logic zero level to the logic one level. In this the control unit 23 controls the annunciator 25 to make the annunciator 25 stop generation of the audible tone. After stopping of the audible tone, if one of the first and the second push button switches 11 and 12 is pushed again, the control unit 23 detects change of the level of one of the first and the second terminals S1 and S2 and controls the display unit 24 to make the display unit 24 put the back light off and stop display of the message. After this, the radio paging receiver is put into a standby mode. In the standby mode, if one of the first and the second push button switches 11 and 12 is pushed, the control unit 23 detects change of the level of one of the first and the second terminals S1 and S2 and controls the display unit 24 so that the display unit 24 puts the back light on and carries out scroll display of the first through the n-th messages in the manner known in the art. For example, when the first push button switch 11 is pushed, the control unit 23 controls the display unit 24 to make the display unit 24 display the first through the n-th messages in inverse order of reception- The control unit 23 controls the display unit 24 to make the display unit 24 display the first through the n-th messages in the order of reception when the second push button switch 12 is pushed. As is obvious from the above description, the control unit 23 serves as mode setting means and carries out a mode setting operation in combination with the first and the second push button switches 11 and 12.

The radio paging receiver is often put in a pocket, such as a breast pocket of a jacket, of the possessor together with a small note book or the like. The radio paging receiver may be put in a bag, such as an attache case, together with books or the like. In this case, the small notebook or the books may push the first and the second push button switches 11 and 12 regardless of possessor's intention. At this time, if the radio paging receiver is put into the standby mode, the display unit 24 puts the back light on and is put into display operation of the first through the n-th messages regardless of whether the possessor wants it or not. Such a display operation is, so to speak, an unintentional display operation. This means that the electric power is wasted in the paging receiver, particularly by turning on the back light.

Figure 4:
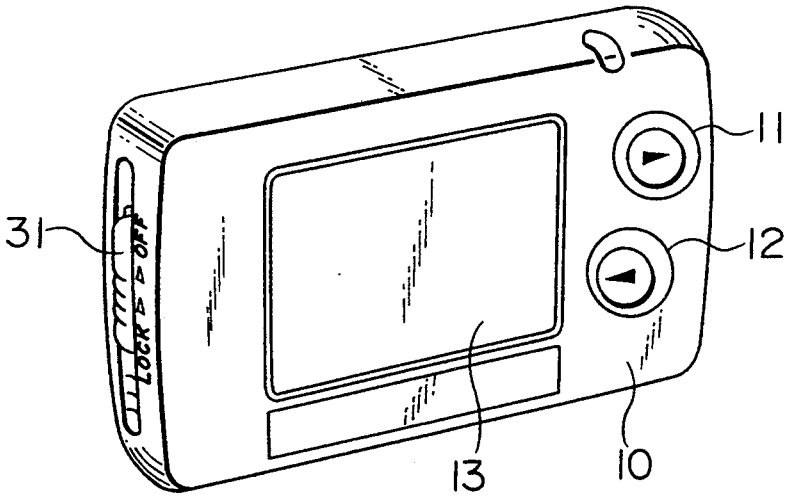
FIG. 4 is a perspective view of a radio paging receiver according to a preferred embodiment of this invention.
Figure 5:
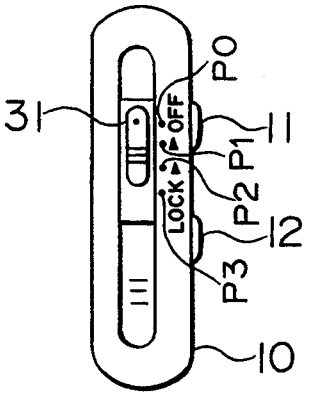
FIG. 5 is a side view of the radio paging receiver illustrated in FIG. 4.
Figure 6:
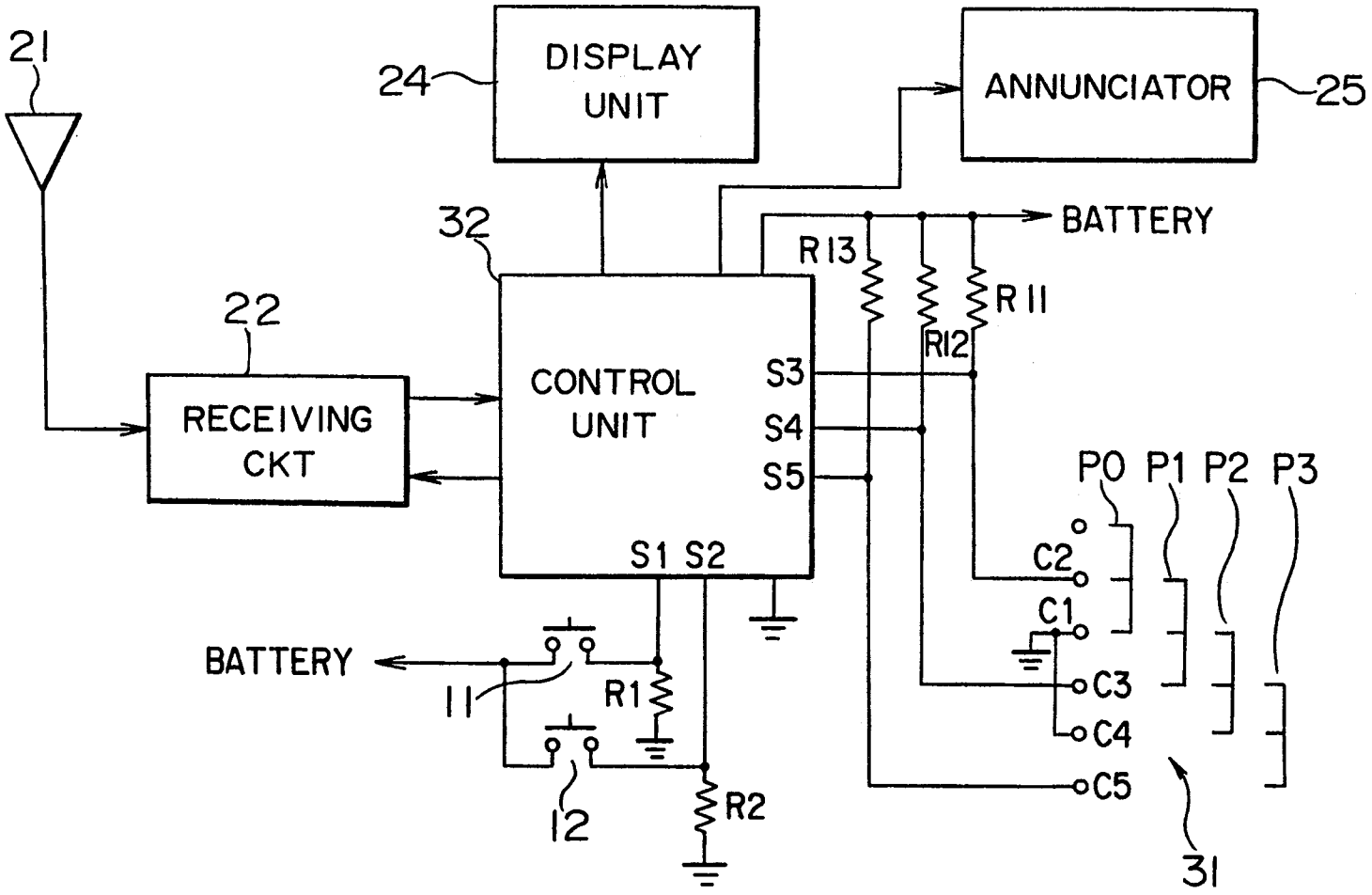
FIG. 6 is a block diagram of the radio paging receiver illustrated in FIG. 4.

Referring to FIGS. 4 to 7, description will proceed to a radio paging receiver according to a preferred embodiment of this invention. The radio paging receiver comprises similar parts designated by like reference numerals except for a elide switch 31 (FIG. 1) and a control unit 32 (FIG. 6). As mentioned before, the radio paging receiver is for selectively receiving a plurality of call signals and a plurality of message signals following the plurality of call signals, respectively. An individual Call number is assigned to the radio paging receiver.

In FIG. 4, the radio paging receiver is provided with a slide switch 31 so that the slide switch 31 protrudes from the side surface of the case 10. As shown in FIG. 5, the slide switch 3i is slidable among the off position, a first through a third position depicted at P0, P1, P2, and P3, respectively. As mentioned before, the slide switch 31 defines the off state of the radio paging receiver when the slide switch 31 is positioned at the off position P0. The slide switch 31 defines the first and the second on states of the radio paging receiver when the slide switch 31 is positioned at the first and the second positions P1 and P2, respectively. It is to be noted here that the slide switch 31 defines a lock or an inhibition state of the radio paging receiver. As will become clear as the description proceeds, the inhibition state is for inhibiting the mode setting operation described in conjunction with FIG. 3.

In FIG. 6, the control unit 32 comprises a fifth terminal S5 in addition to the first through the fourth terminals S1 to S4 described in conjunction with FIG. 3. The radio paging receiver is provided with fourth and fifth contacts C4 and C5 in addition to the first through the third contacts C1 to C3 along a slide path of the slide switch 31. It is to be noted here that the first through the third contacts C1 to C3 are arranged in different order relative to an arrangement of the first through the third contacts C1 to C3 shown in FIG. 3. Namely, the first contact C1 is grounded and is connected to the fourth contact C4. The second contact C2 is connected to the third terminal S3 and is connected to the battery through the first pull-up resistor R11 as mentioned with reference to FIG. 3. The third contact C3 is connected to the fourth terminal S4 and is connected to the battery through the second pull-up resistor R12 as mentioned before. The fifth contact C5 is connected to the fifth terminal S5 and is connected to the battery through a third pull-up resistor R13.

When the glide switch 14 is positioned at the off position P0 by the possessor, the radio paging receiver is put into the off state, namely, an inactive state. In this state, only the third terminal S3 has a logic zero level because the slide switch 31 connects between the first and the second contacts C1 and C2 while each of the fourth and the fifth terminals S4 and S5 has a logic one level. When the slide switch 31 is positioned at the first position P1, the radio paging receiver is put into the first on state, namely, an active state by the electric power. In this state, each of the third and the fourth terminals S3 and S4 has the logic zero level, This is because the first contact C1 is connected to the second and the third contacts C2 and C3 through the slide switch 31. Similarly, when the slide switch 31 is positioned at the second position P2, the radio paging receiver is put into the second on state, namely, the active state. In this state, only the fourth terminal S4 has the logic zero level. This is because the first contact C1 is connected to the third contact C3 through the slide switch 31. When the slide switch 31 is positioned at the third position P3, the radio paging receiver is put into a third on state, namely, the active state. In this state, the fourth and the fifth terminals S4 and S5 has the logic zero level while the third terminal S3 has the logic one level. This is because the fourth contact C4 connected to the first contact C1 is connected to the third and the fifth contacts C3 and C5 through the slide switch 31.

Let the slide switch 31 be positioned at the first position P1. In this event, the receiving circuit 22 receives the call signal and the message signal representing a message and following the call signal as a received call signal and a received message signal, respectively, through the antenna 21. The receiving circuit 22 supplies the received call and the received message signals to the control unit 32. Supplied with the received call and the received message signals, the control unit 32 carries out at first a judging operation for judging whether or not the received call signal is coincident with the individual call number. The control unit 32 serves as judging means in combination with the receiving circuit 22. When the resolved call signal is coincident with the individual call number, the control unit 32 stores the received message signal into the memory and supplies the received message signal to the display unit 24. In this state, the control unit 32 further supplies the first audible tone signal to the annunciator 25 when the third and the fourth terminal S3 and S4 has the logic zero level. The memory memorizes the received message signal as the memorized message signal. Simultaneously, the display unit 24 puts the back light on and displays the message. Supplied with the first audible tone signal, the annunciator 25 generates audible tone at the first predetermined volume.

If the slide switch 31 is positioned at the second position P2, the control unit 32 stores the received message signal into the memory and supplies the received message signal to the display unit 24 when the received call signal is coincident with the individual call number. In this state, the control unit 32 further supplies the second audible tone signal to the annunciator 25 when only the fourth terminal S4 has the logic zero level. In this case, the annunciator 25 generates the audible tone at a second predetermined volume.

As mentioned in conjunction with FIG. 3, the annunciator 25 may comprise the speaker and the vibrator. In this event, the control unit 32 may supply an audible tone signal to the speaker to make the speaker generate the audible tone when the slide switch 31 is positioned at the first position P1. If the slide switch 31 is positioned at the second position P2, the control unit 32 may supply the drive signal to the vibrator to vibrate the vibrator. Furthermore, the memory is implemented by FIFO (first-in first-out) memory as mentioned before.

Let the memory memorize the first through the n-th message signals as the first through the n-th memorized message signals. If one of the first and the second push button switches 11 and 12 is pushed by the possessor on generation of the audible tone, the voltage level of one of the first and the second terminals S1 and S2 changes from the logic zero level to the logic one level. In this event, the control unit 32 controls the annunciator 25 to make the annunciator 25 stop generation of the audible tone. After stopping of the audible tone, if one of the first and the second push button switches 11 and 12 is pushed again, the control unit 32 detects change of the voltage level of one of the first and the second terminals S1 and S2 and controls the display unit 24 to make the display unit 24 put the back light off and stop display of the message. After this, the radio paging receiver is put into a standby mode. In the standby mode, if one of the first and the second push button switches 11 and 12 is pushed, the control unit 32 detects change of the voltage level of one of the first and the second terminals S1 and 82 and controls the display unit 24 so that the display unit 24 puts the back light on again and carries out the scroll display of the first through the n-th messages. For example, when the first push button switch 11 it pushed, the control unit 32 controls the display unit 24 to make the display unit 24 display the first through the n-th message in inverse order of reception. The control unit 32 controls the display unit 24 to make the display unit 24 display the first through the n-th messages in the order of reception when the second push button switch 12 is pushed under the circumstances, the control unit 32 serves as mode setting means in combination with the first and the second push button switches 11 and 12.

Figure 7:
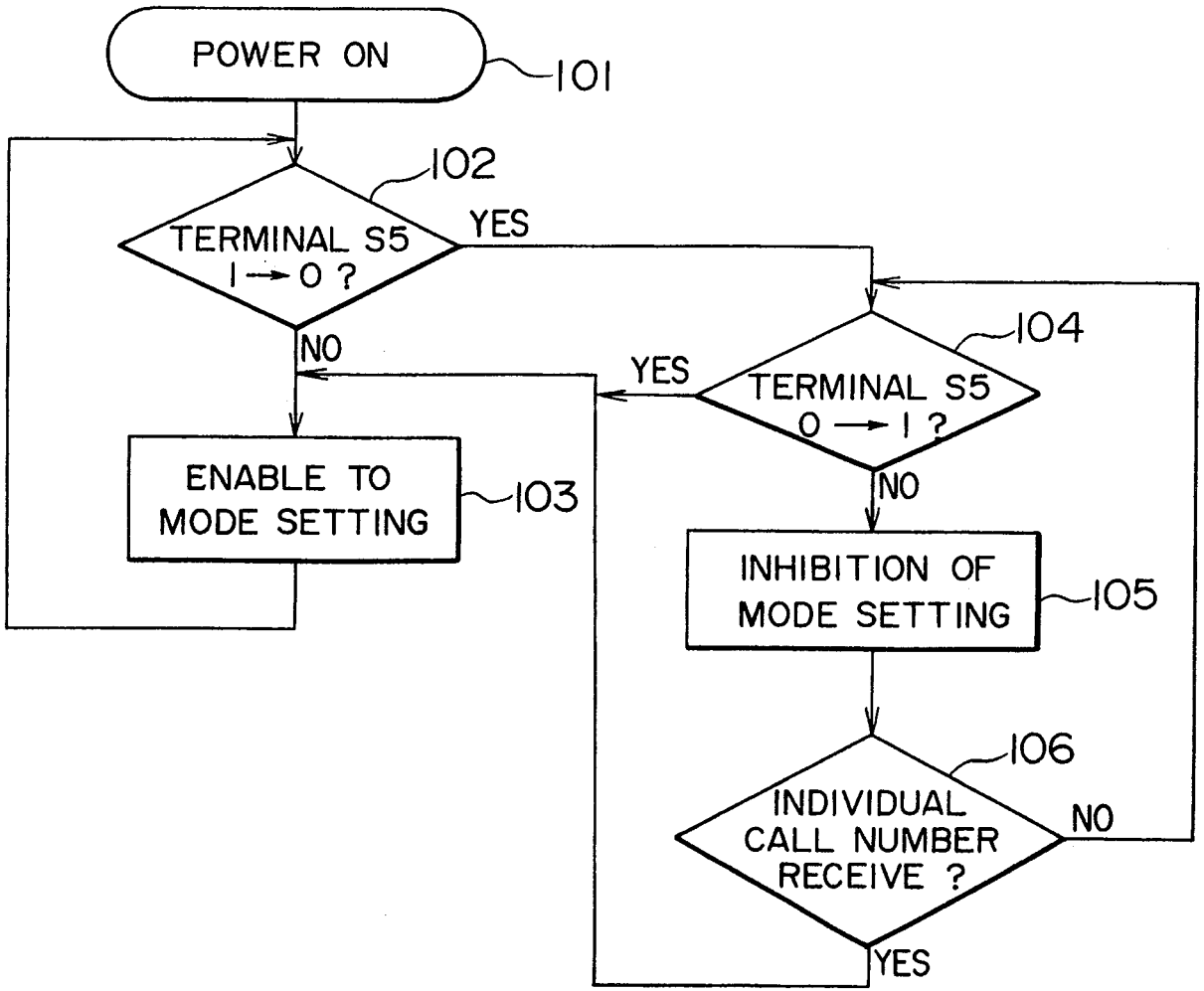
FIG. 7 is a flow chart for use in describing operation of a control unit of the radio paging receiver illustrated in FIG. 4.

Description will proceed to the inhibition state with reference to FIGS. 6 and 7. Let the slide switch 31 be positioned at the third position P3. In this state, the control unit 32 disables the mode setting which is set by one of the first and the second push button switches 11 and 12 as will presently be described. In other words, the control unit 32 disregards the change the voltage level of each of the first and the second terminals S1 and S2.

In FIG. 7, the slide switch 31 is positioned at one of the first and the second positions P1 and P2 at a first step 101. In this state, the fifth terminal S5 has the logic one level as mentioned before. At a second step 102, the control unit 32 detects whether or not the voltage level of the fifth terminal 85 changes from the logic one level to the logic zero level. In other words, the control unit 32 detects whether or not the slide switch 31 is shifted to the third position P3 by the possessor. In this event control unit 32 serves as a detecting means at second step 102. If the control unit 32 does not detect the change of the voltage level of the fifth terminal S5, operation proceeds to a third step 103. At the third step 103, the control unit 32 allows a mode to be set by one of the first and the second push button switches 11 and 12. In other words, the display unit 24 can carry out the display operation when one of the first and the second push button switches 11 and 12 is pushed. Similarly, the annunciator 25 can carry out the announcing operation. In this event, control unit 32 serves as accepting means. When the control unit 32 detects the change of the voltage level of the fifth terminal S5, namely, the change from the logic one level to the logic zero level, the second step 102 is succeeded by a fourth step 104.

At the fourth step 104, the control unit 32 detects whether or not the voltage level of the fifth terminal S5 changes from the logic zero level to the logic one level. When the control unit 32 detects the change of the voltage level of the fifth terminal S5, operation turns back to the third step 103. If the control unit 32 does not detect the change of the voltage level of the fifth terminal S5, operation proceeds to a fifth step 105. At the fifth step 105, the control unit 32 inhibits one of the first and second push button switches 11 and 12 from setting a mode. In other words, the control unit 32 disregards the change of the voltage level of each of the first and the second terminals S1 and 82. In this state, the display unit 24 is put into the inhibition state wherein the display unit 24 can not carry out the display of the message regardless of push operation of one of the first and the second push button switches 11 and 12. In this state, the display unit 24 never puts the back light on. The control unit 32 serves, in combination with the slide switch 31, as inhibition means at the fifth step 105.

The fifth step 105 is succeeded by a sixth step 106. At the sixth step 106, the control unit 32 detects whether or not the receiving circuit 22 receives the call signal having the individual call number. In other words, the control unit 32 detects whether or not the received call signal is coincident with individual call number. If the control unit 32 does not detect reception of the call signal having the individual call number, operation turns back to the fourth step 104. When the control unit 32 detects the reception of the call signal having the individual call number, operation turns back to the third step 103. The control unit 32 serves, in combination with the receiving circuit 22, as cancel means at the sixth step 106.

As is obvious from the above description, when the slide switch 31 is positioned at the third position P3, the display unit 24 is restricted in display operation of the message by the control unit 32. Let the radio paging receiver be put in a pocket, such as a breast pocket of a jacket, of the possessor together with a small notebook or the like. If the small notebook pushes one of the first and the second push button switches 11 and 12 in the standby mode regardless of possessor's intention, the display unit 24 never puts the back light on and does not carry out the display operation under the control of the control unit 32 described above while the slide switch 31 is positioned at the third position P3, Thus, it is possible to prevent an unintentional display operation caused by undesired activation of the first and second push button switches 11 and 12.

While this invention has thus far been described in conjunction with a preferred embodiment thereof, it will readily be possible for those skilled in the art to put this invention into practice in various other manners. For example, this invention is applied to a radio paging receiver which does not use the back light and is applied to other radio communication apparatus, such as a transceiver or the like.

What is claimed is:

1. A radio communication apparatus having an individual call number and being capable of operating in one of a standby mode wherein the apparatus is waiting to receive a call signal that is coincident with the individual call number and a message received mode wherein the apparatus has received a call signal that is coincident with the individual call number, the apparatus comprising:

receiving means for receiving a call signal as a received call signal, and a message signal representing a message;

judging means connected to said receiving means for judging whether or not said received call signal is coincident with said individual call number, said judging means producing said message signal when said received call signal is coincident with said individual call number;

display means connected to said judging means for displaying said message;

display mode setting means operatively connected to said judging means for setting a display mode of said display means, wherein said display means is operable to display said message;

prevention means for preventing an unintentional display operation of said display means while said radio communication apparatus is in the standby mode, said prevention means including inhibition means having an active state and an inactive state and operatively connected to said display mode setting means for inhibiting said display mode setting means from setting said display mode while said inhibition means is in said active state and while said radio communication apparatus is in the standby mode;

slide switch means connected to said inhibition means for putting said inhibition means into said active state while said slide switch means is positioned at a predetermined position and for putting said inhibition means into said inactive state while said slide switch means is positioned at a preselected position that is different from said predetermined position;

detecting means connected to said slide switch means for detecting whether said slide switch means is positioned at said predetermined position;

accepting means connected to said detecting means for permitting said display mode setting means to set said display mode while said slide switch means is positioned at said preselected position; and cancel means operatively connected to said judging means, said inhibition means, and said detecting means for cancelling an inhibition operation of said inhibition means in response to said judging means judging a coincidence between said received call signal and said individual call number.

2. A radio communication apparatus as claimed in claim 1, wherein said apparatus further comprises:

push switch means connected to said display mode setting means for putting said mode setting means into operation.

* * * * *